US006575777B2

(12) United States Patent
Henriott et al.

(10) Patent No.: US 6,575,777 B2
(45) Date of Patent: Jun. 10, 2003

(54) PARTITION WIRING SYSTEM

(75) Inventors: Jay M. Henriott, Jasper, IN (US); Keith A. Hoffman, Huntingburg, IN (US); Jennifer L. Hibler, Fort Wayne, IN (US)

(73) Assignee: Kimball International, Inc., Jasper, IN (US)

( * ) Notice: Subject to any disclaimer, the term of this patent is extended or adjusted under 35 U.S.C. 154(b) by 0 days.

(21) Appl. No.: 10/000,824

(22) Filed: Oct. 23, 2001

(65) Prior Publication Data

US 2002/0052133 A1 May 2, 2002

Related U.S. Application Data

(60) Provisional application No. 60/242,305, filed on Oct. 30, 2000.

(51) Int. Cl.[7] ..... H01R 4/60

(52) U.S. Cl. ..... 439/215; 439/654

(58) Field of Search ..... 431/215, 440, 431/49, 211, 92, 170, 222, 640, 535, 557, 717, 573, 209; 439/654, 105, 107; 174/53, 50.52, 59

(56) References Cited

U.S. PATENT DOCUMENTS

| | | | | |
|---|---|---|---|---|
| 2,714,713 A | | 8/1955 | Parajon | 339/164 |
| 3,922,478 A | | 11/1975 | Perkey | 174/53 |
| 4,235,495 A | | 11/1980 | Propst et al. | 339/22 R |
| 4,278,834 A | | 7/1981 | Boundy | 174/48 |
| 4,295,697 A | | 10/1981 | Grime | 339/22 R |
| 4,313,646 A | * | 2/1982 | Millhimes et al. | 439/156 |
| 4,367,370 A | | 1/1983 | Wilson et al. | 174/48 |
| 4,370,008 A | | 1/1983 | Haworth et al. | 339/4 |
| 4,377,724 A | | 3/1983 | Wilson | 174/48 |
| 4,429,934 A | | 2/1984 | VandenHoek et al. | 339/22 R |
| 4,445,737 A | | 5/1984 | Long et al. | 339/18 C |
| 4,634,212 A | | 1/1987 | Boundy et al. | 339/198 R |
| 4,684,186 A | | 8/1987 | Hetherington | 439/171 |
| 4,740,167 A | * | 4/1988 | Millhimes et al. | 439/92 |
| 4,907,384 A | | 3/1990 | Underwood | 52/126.6 |
| 4,918,886 A | | 4/1990 | Benoit et al. | 52/221 |
| 4,952,164 A | | 8/1990 | French et al. | 439/215 |

(List continued on next page.)

*Primary Examiner*—P. Austin Bradley
*Assistant Examiner*—Phuong Chi Nguyen
(74) *Attorney, Agent, or Firm*—Baker & Daniels

(57) ABSTRACT

An electrified partition system having a plurality of panels interconnected with each other to form a plurality of work spaces. A plurality of receptacles are mounted in raceways located in the panels with each receptacle including a housing and a plurality of conductors extending from one end of the housing to the other end of the housing. The conductors terminate in respective terminals and define individual circuits. At least one electrical socket is disposed in a face of each of the receptacle housings and include a plurality of connectors positioned behind respective apertures in the housing face to receive a standard multi-pronged electrical plug. The connectors are connected to respective conductors which are fewer in number than the plurality of conductors so that some of the conductors pass through the housing electrically isolated from the connectors. Multi-circuit cables connect the terminals of the receptacles to form an electrical network.

12 Claims, 11 Drawing Sheets

U.S. PATENT DOCUMENTS

| | | | | | |
|---|---|---|---|---|---|
| 5,013,252 | A | | 5/1991 | Nienhuis et al. | 439/215 |
| 5,015,203 | A | | 5/1991 | Furrow | 439/535 |
| 5,057,647 | A | | 10/1991 | Bogden et al. | 174/48 |
| 5,073,120 | A | | 12/1991 | Lincoln et al. | 439/92 |
| 5,112,240 | A | | 5/1992 | Nienhuis et al. | 439/215 |
| 5,116,235 | A | | 5/1992 | Nienhuis et al. | 439/215 |
| 5,129,835 | A | | 7/1992 | DeFouw et al. | 439/215 |
| 5,131,860 | A | * | 7/1992 | Bogiel | 439/215 |
| 5,178,555 | A | | 1/1993 | Kilpatrick et al. | 439/215 |
| 5,186,640 | A | | 2/1993 | McCoy | 439/211 |
| 5,236,370 | A | | 8/1993 | King et al. | 439/215 |
| 5,252,086 | A | | 10/1993 | Russell et al. | 439/215 |
| 5,277,609 | A | | 1/1994 | Ondrejka | 439/215 |
| 5,318,454 | A | | 6/1994 | Deer et al. | 439/215 |
| 5,503,565 | A | | 4/1996 | McCoy | 439/171 |
| 5,562,469 | A | | 10/1996 | Nienhuis et al. | 439/275 |
| 5,582,522 | A | | 12/1996 | Johnson | 439/214 |
| 5,584,714 | A | | 12/1996 | Karst et al. | 439/215 |
| 5,655,933 | A | | 8/1997 | Skowronski | 439/654 |
| 5,755,583 | A | | 5/1998 | McCarthy | 439/215 |
| 5,915,984 | A | | 6/1999 | Rupert et al. | 439/215 |
| 5,941,720 | A | | 8/1999 | Byrne | 439/215 |

* cited by examiner

PARTITION WIRING SYSTEM

BACKGROUND OF THE INVENTION

The present invention relates to a wiring system used to provide electricity to individual work spaces created by a plurality of partitions subdividing an office area.

Open office space is typically partitioned to be used efficiently. By using a plurality of office panels or partitions, valuable space can be divided into individual cubicles providing employees with their own work spaces. The office panels are generally rectangular and may be provided with decorative surfaces. Each panel is provided with fasteners along the side edges which allow several adjacent panels to be attached to one another in orientations such as end to end or perpendicularly to one another.

Each panel is provided with a raceway which extends the length of each panel and is used to support a wiring system. The raceway may be located along the lower edge of the panel or near the middle of the panel at a height above the upper surface of a work surface such as a desk top. The wiring system is used to electrically connect adjacent panels while providing each panel with electricity. The wiring system includes receptacles mounted on a distribution harness (FIGS. 4 and 5) which, when supplied with electricity, provides each individual work station with receptacles for electrically operated equipment such as computers, lamps or the like. The receptacles are conventionally duplex receptacles in that each receptacle is provided with a pair of outlets.

Referring to FIGS. 4 and 5, one method of supplying electrical receptacles 40 to a plurality of individual work stations defined by office panels includes the use of buss or distribution harness 38. Each end of distribution harness 38 is provided with connector 44 having a plurality of openings for receiving the socket ends of the receptacles 40, jumper cables and power entry. Electrical current is supplied to the wiring system from either a ceiling power entry 61, which would plug into one outlet of a receptacle, or a floor power entry 61, which is plugged into connector 44 secured to one end 43 of distribution harness 38 (FIG. 5). From power entry 61, the electrical current travels through distribution harness 38 to receptacles 40.

Receptacles 40 are electrically connected to distribution harness 38 which carries a plurality of jacketed wires or buss bars which are constructed from stamped metal (not shown). Distribution harness 38 typically carries eight or ten wires (although the present invention is not so limited) with each receptacle 40 being electrically connected to a ground wire, a neutral wire and a hot wire, the three wires defining a circuit. If desired, each receptacle 40 attached to harness 38 may be electrically connected to the same ground and neutral wires, however, receptacles 40 may be connected to different hot wires to define a second circuit. The first receptacle 40 is in engagement with connector 44 located at one end of distribution harness 38 and is connected to a combination of three wires of a first circuit. The second receptacle 40, plugged into connector 44 at the opposite end of distribution harness 38, may be electrically connected to the same or a second combination of three wires of a second circuit. By placing two receptacles on two separate circuits, overloading of a single circuit is prevented if, for example, more than one piece of equipment was plugged into receptacles 40 on that single circuit.

Distribution harness 38 is provided with elongated body portion 42 having ends 43. One connector 44 is integrally attached to elongated body 42 at each end 43 (FIG. 5) and connectors 44 include sockets 46 having openings 47, one pair of sockets protruding from each side of connector 44. Socket 46 of connector 44 electrically connects with socket 48 located at one end of receptacle 40 while one socket 49 at the end of jumper cable 50 is electrically linked to socket 47 of connector 44 to define a pathway for electrical current between receptacle 40, connector 44 and jumper cable 50. One receptacle 40 is electrically attached to each socket 46 of connector 44 such that receptacles 40 may be mounted adjacent one another. A pair of receptacles 40 may be placed in one office panel being spaced the length of distribution harness 38. One socket 49 of jumper cable 50 is secured to socket 47 of connector 44 while the second socket 49 of cable 50 is secured to a socket of a second connector disposed on distribution harness 38 in an adjacent office panel, thereby allowing distribution harnesses 38 of adjacent office panels to be electrically connected (FIG. 4).

Once receptacles 40 are electrically joined with connectors 44, receptacles 40 are secured to brackets 52 which are in turn fixed to distribution harness 38 (FIG. 5). Tabs 54 extending from receptacle housing 56 are provided with apertures 58 which align with apertures 60 in brackets 52. Fasteners are placed through aligned apertures 58 and 60, securing receptacles 40 to buss or harness 38. A plurality of wires or stamped buss bars (not shown) extend the length of distribution harness 38 between connectors 44. All eight or ten wires are carried through connectors 44 to form contacts (not shown). Each receptacle 40 includes three wires (not shown) extending through receptacle 40, connecting with connectors which align with each opening of the outlets in receptacle 40. These wires have contacts at each end which provide means for electrically connecting to different combinations of ground, neutral and hot wires in connector 44. By having each receptacle 40 associated with a separate circuit, overloading of a single circuit is prevented.

A problem with the current wiring system is the cost of the distribution harness. The distribution harness is a relatively large component of the system which requires that the raceway disposed at the bottom of the office panel be large enough to support the assembly. This adds to the cost of manufacturing and assembling the office panels when the wiring system is installed. Further, the size of the distribution harness limits the number of receptacles to two in each panel. The distribution harness is an expensive component of the wiring assembly which in turn increases the overall expense of supplying electricity to a plurality of work stations in an office. The assembly of the distribution harness assembly is time consuming due to the number of parts which must be assembled which again increases the cost of manufacturing. Furthermore, outlets in a duplex receptacle must be on the same circuit.

It is desired to provide a wiring assembly for providing office panels with a plurality of receptacles which eliminates the need for a distribution harness while being cost effective and easy to assemble.

SUMMARY OF THE INVENTION

The present invention relates to a wiring assembly for office panels in which the wires conventionally carried by the distribution harness are carried directly by the receptacle, thus eliminating the buss or distribution harness. The receptacle is preferably plugged into a quad connector and the wiring system is supplied power by a typical ceiling or floor power entry. Each receptacle picks off three wires from the eight or ten wires carried by the receptacle to provide the receptacle with electrical power. The receptacles may be wired to one circuit or a plurality of circuits to a partitioned area depending on how the area is being utilized. A jumper cable links one end of the first receptacle to one end of a second receptacle. The receptacles are wired in different circuits by being electrically connected to a different combination of three wires.

If desired, each outlet in a duplex or larger receptacle could be connected to a different circuit.

The advantages of eliminating the distribution harness include reducing the size of the wiring assembly as well as the cost of the assembly. The installation time required for placing the electrical assembly within the raceways of a plurality of office panels has also been reduced, which in turn lowers the expense of manufacturing. By wiring each receptacle or each outlet to be on a specific circuit, a work space may be provided with any number of circuits, from one to four in each panel depending on the needs of the office area.

BRIEF DESCRIPTION OF THE DRAWINGS

The above mentioned and other features and objects of this invention, and the manner of attaining them, will become more apparent and the invention itself will be better understood by reference to the following description of the embodiment of the invention taken in conjunction with the accompanying drawings, wherein.

Figure 1:
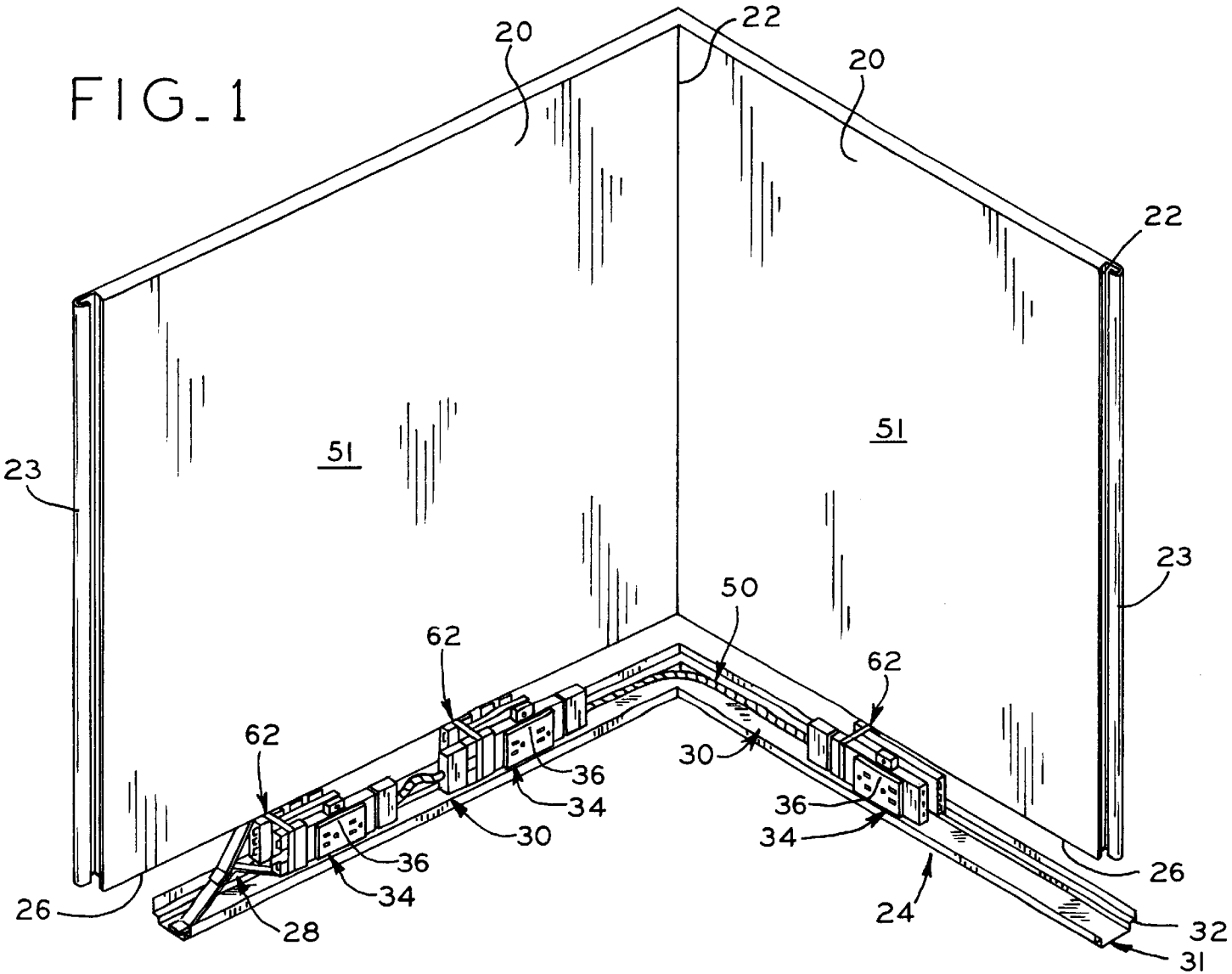
FIG. 1 is a perspective view of an office panel assembly in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, and such exemplifications are not to be construed as limiting the scope of the invention.

DETAILED DESCRIPTION OF THE INVENTION

Figure 3:
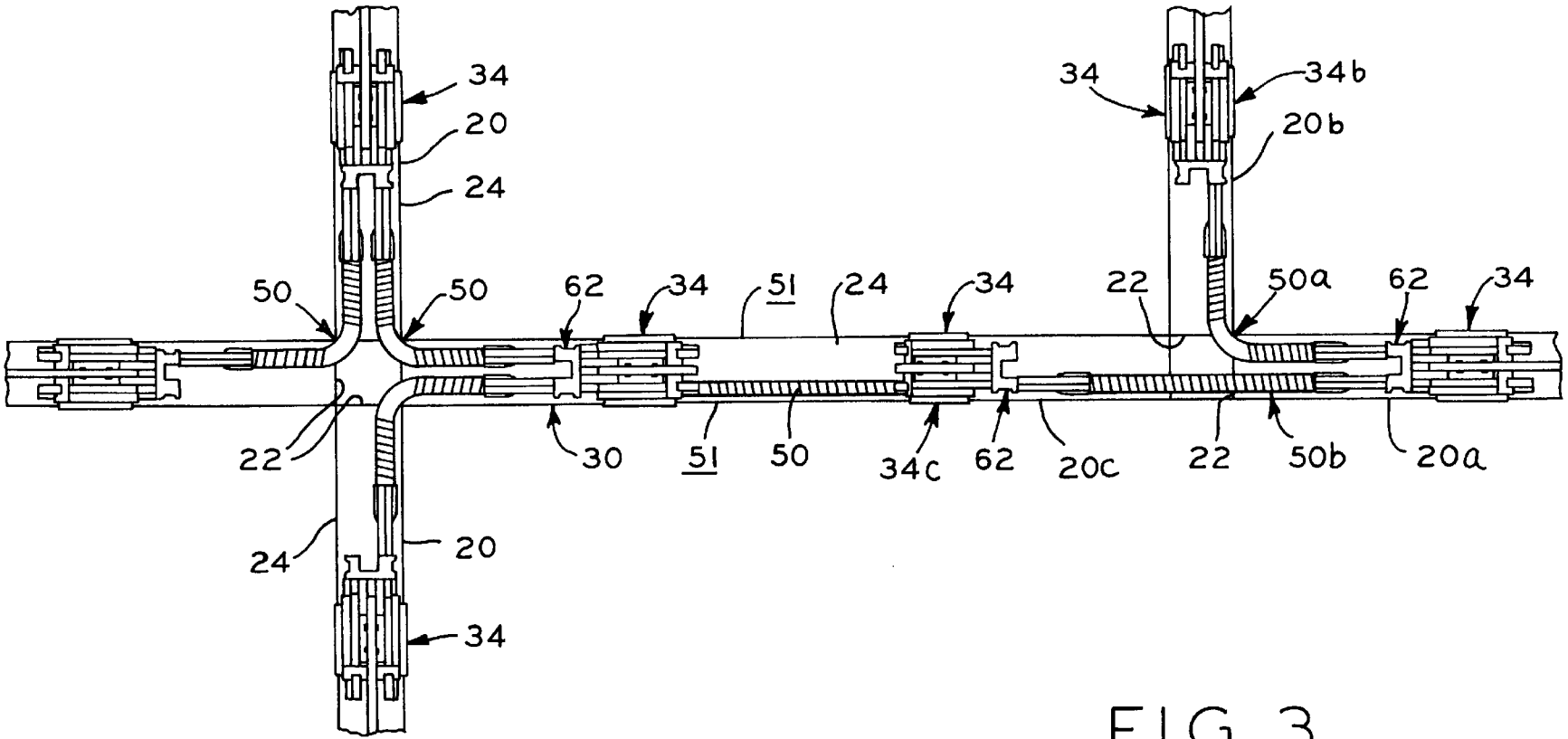
FIG. 3 is a diagrammatic plan view of the wiring assembly installed in an office panel assembly in accordance with the present invention.

Referring to FIGS. 1 and 3, a plurality of panels 20 are secured to one another to partition large areas such as in an office building. Panels 20 have side edges 22 provided with interlocking channels and posts (not shown) disposed thereon for securing sides 22 of adjacent panels 20 together. An example of the panel interlocking system is disclosed in U.S. Pat. No. 4,907,384 which is assigned to the assignee of the present application and is expressly incorporated herein by reference. By attaching a plurality of panels 20 to one another in any suitable orientation including panels 20 being disposed side to side or at right angles to one another, an office area can be divided into a number of individual work spaces.

Figure 2:
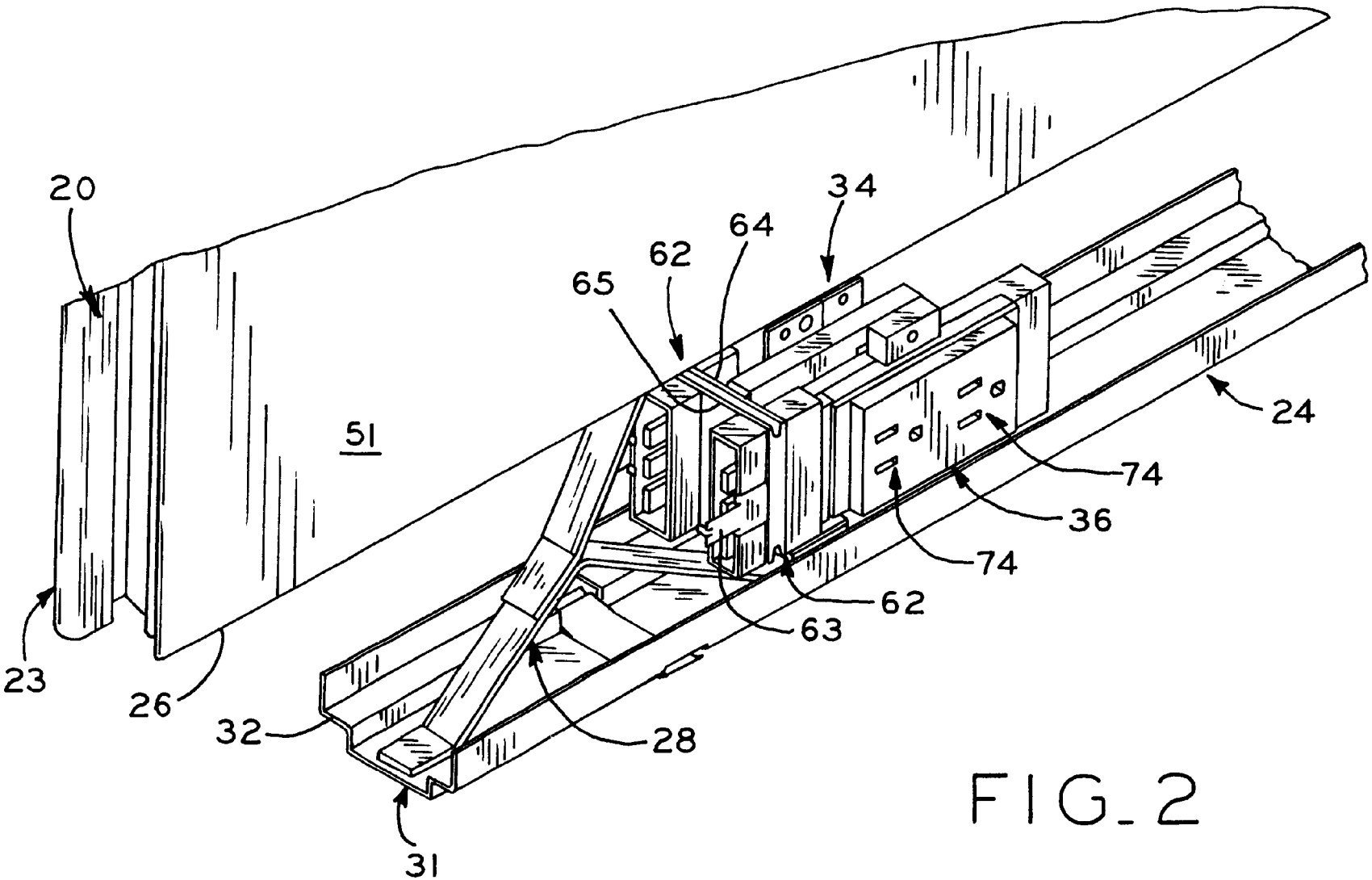
FIG. 2 is an enlarged, fragmentary view of a portion of the wiring assembly of the office panel assembly shown in FIG. 1.

Each panel 20 is provided with raceway 24 which is disposed along lower edge 26 thereof and is suspended below panel 20 by supporting members 28 (FIGS. 1 and 2). Raceway 24 is formed from metal and may be of any shape appropriate for supporting wiring assembly 30 as will be described hereinbelow. An example of the raceway for the panel system is disclosed in U.S. Pat. No. 4,918,886, which is assigned to the assignee of the present application and is expressly incorporated herein by reference. Raceway 24 of this embodiment includes base 31 for supporting wiring assembly 30, which includes at least one electrical assembly 34 resting upon ledge 32 of raceway 24 as shown in FIGS. 1 and 2. Cover plates (not shown) are positioned along the length of panel 20 being secured thereto between base 31 and lower edge 26 of panel 20. The cover plates are attached to raceway 24 by any suitable fastening method including being snap fit or held in position by screws or the like. The cover plates protect the wires of assembly 30 from damage and are also provided for the safety of people occupying the work space. Apertures are provided in such cover plates to allow receptacles 36 of electrical assemblies 34 (FIGS. 1 and 2) to be exposed. Wiring assembly 30 includes a plurality of separate electrical assemblies 34, generally two, which are spaced along each raceway 24 and thus panel 20 to provide electricity to the partitioned office space.

Figure 6:
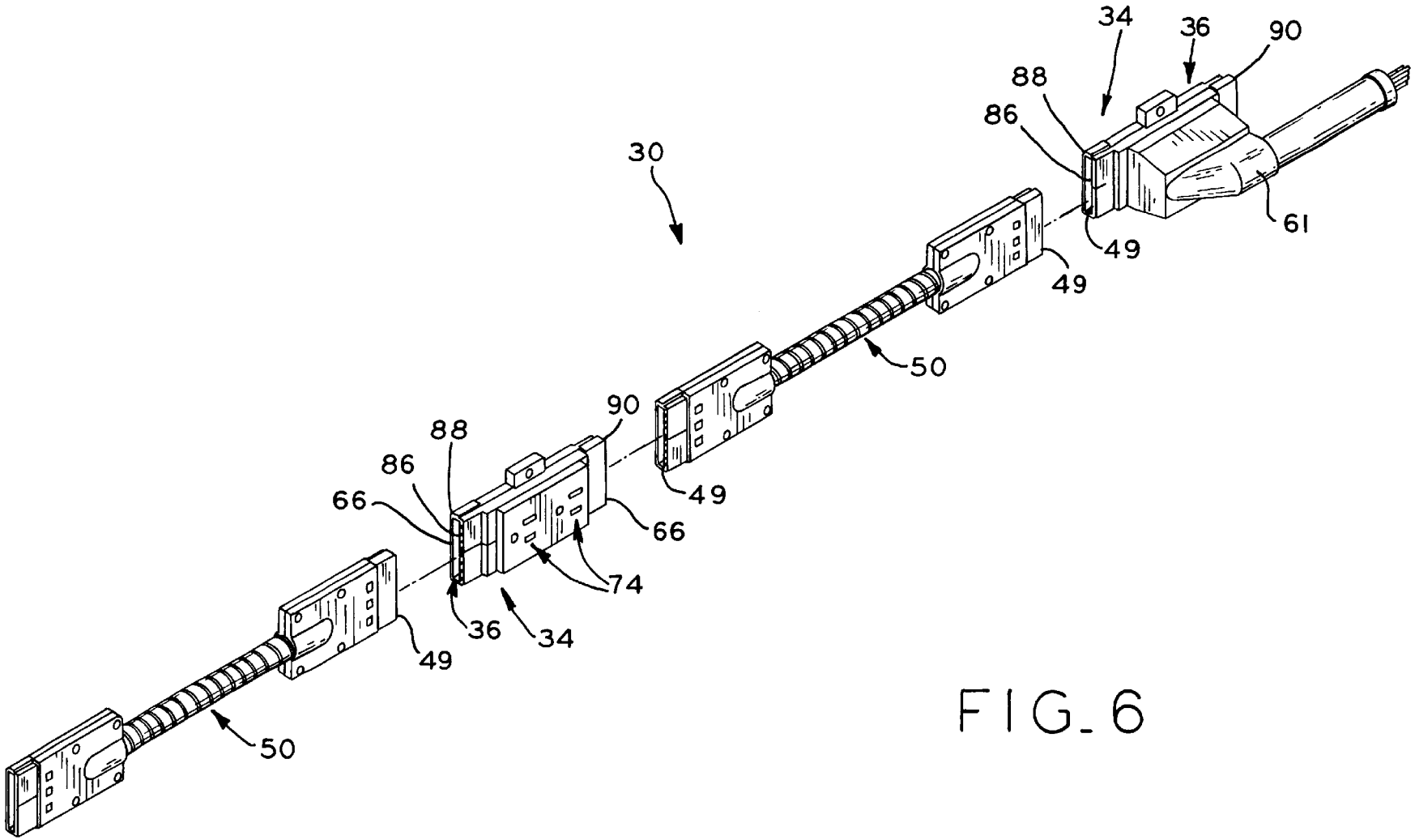
FIG. 6 is an exploded perspective view of the wiring assembly of the present invention including a single receptacle.
Figure 7:
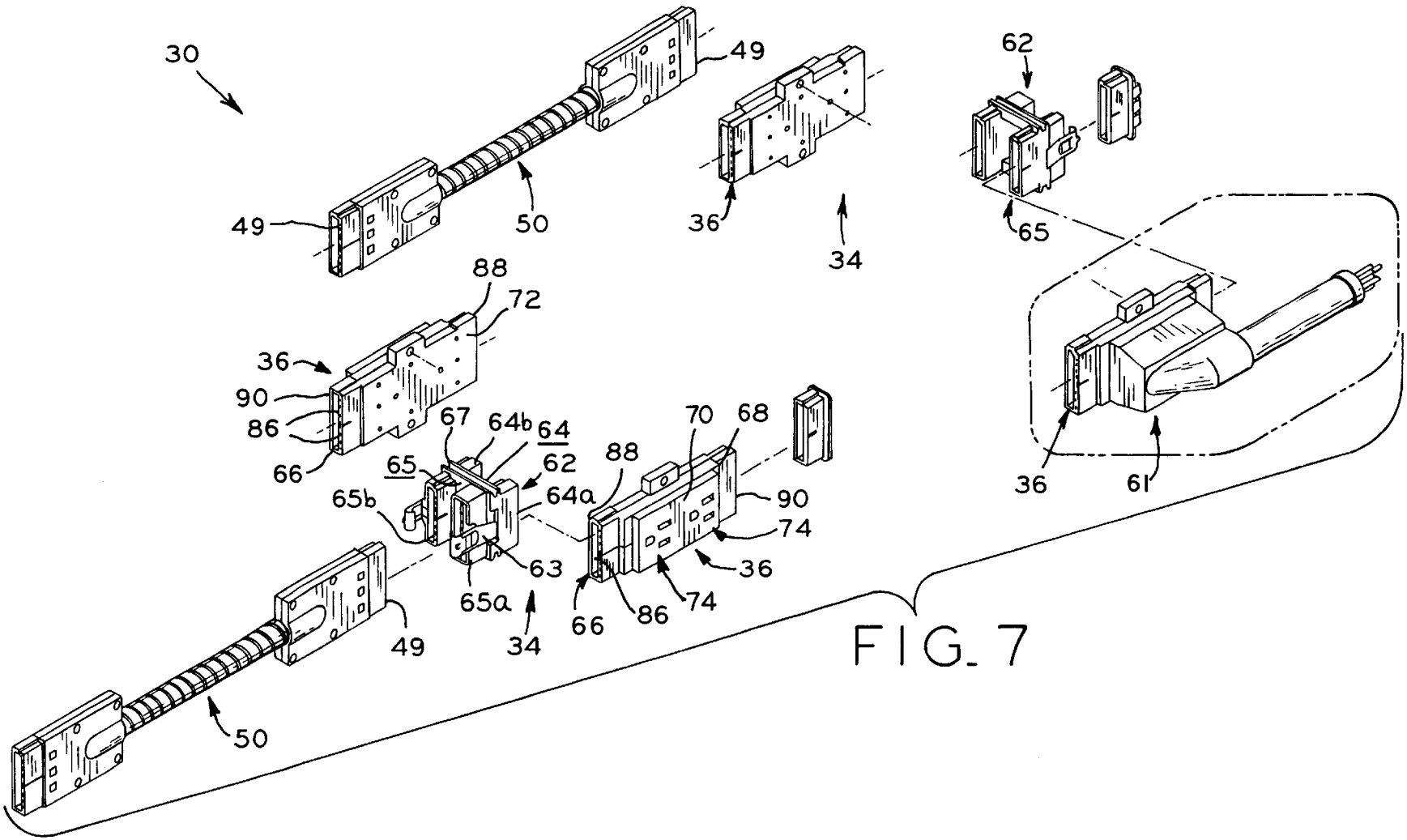
FIG. 7 is an exploded perspective view of the wiring assembly of the present invention including a pair of receptacles mounted back-to-back.
Figure 12:
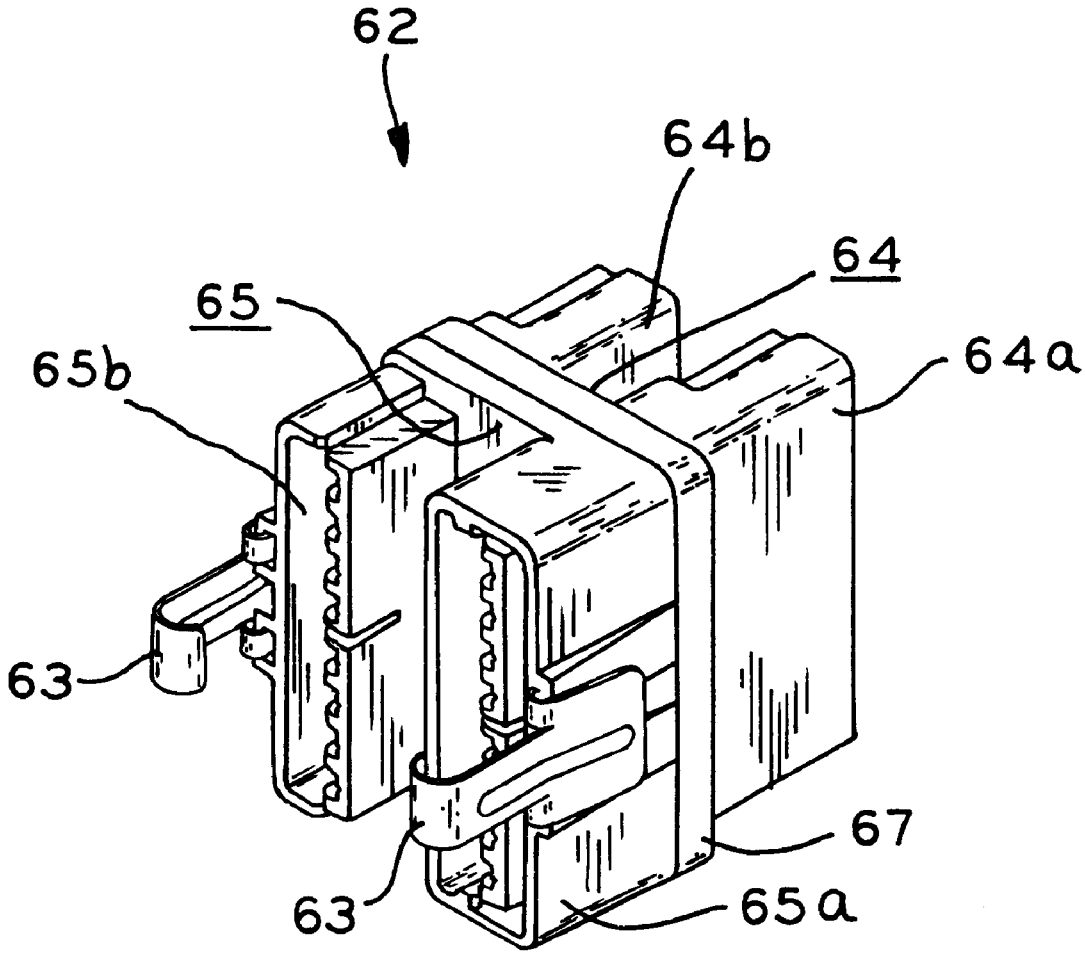
FIG. 12 is an enlarged perspective view of a quad connector in accordance with the present invention.

Referring to FIGS. 2, 6 and 7, receptacles 36 have connectors or sockets 66 disposed at each end for electrically connecting to jumper cables 50. Sockets 66 are male in construction and are received by female sockets 49 of jumper cables 50. Referring to FIG. 6, when electrical assembly 34 is provided with a single receptacle 36, a plurality of assemblies 34 are interconnected by jumper cables 50. A series of receptacles 36 may be electrically connected by connecting socket 66 of one receptacle 36 with socket 49 of jumper 50 and socket 66 of a second receptacle 36 is received by the second socket 49 of jumper 50. As usual, one end of the series of electrical assemblies is supplied with electrical current by power entry 61 or a jumper from an adjacent panel. When mounting receptacles 36 back-to-back to provide front and back surfaces 51 of panels 20 with electrical outlets or when panels 20 are disposed perpendicularly to one another as illustrated in FIG. 3, each assembly 34 further includes quad connector 62 module. Referring to FIGS. 7 and 12, quad connector 62 module includes surfaces 64 and 65 each having a pair of sockets 64*a*, 64*b*, and 65*a*, 65*b* protruding therefrom, respectively, and all electrically connected to each other. Sockets 64*a* and 64*b* are flush with edges 67 of quad connector 62 and are female in construction so as to electrically connect with male sockets 66 of receptacles 36. Sockets 65*a* and 65*b* are male and are received in female sockets 49 of jumper cables 50. Male sockets 65*a* and 65*b* are offset from edges 67 of quad connector 62, being disposed inwardly from edges 67. In assembly of wiring assembly 34, female socket 49 of cable 50 is connected to one male socket 65*a* or 65*b* of connector 62 and one female socket 64*a* or 64*b* receives male socket 66 of receptacle 36. Once cable 50 is electrically connected to quad connector 62, resilient metal locking tabs 63 located on both sides of connector 62 engage a portion of socket 49 of cable 50 to prevent cable 50 from becoming dislodged from engagement with quad connectors 62 (FIGS. 1, 2, 3 and 12). It is understood that locking tabs 63 is only one method of locking cable 50 into engagement with quad connectors 62 and that any suitable method may be used.

As illustrated in FIGS. 3 and 7, quad connector 62 has the capability of supporting a pair of duplex receptacles 36, with a receptacle 36 electrically connected to each socket 64*a* and 64*b* of quad connector 62. The pair of sockets 65*a* and 65*b* of connector 62 are provided on the opposite side of quad connector 62 and are able to receive sockets 49 of two jumper cables 50. For example, in one panel system shown in FIG. 3, one jumper cable 50*a* secures one electrical assembly 34*a* to a second electrical assembly 34*b* between two panels 20*a* and 20*b* that are disposed perpendicular to one another. A second jumper cable 50*b*, electrically connected to first assembly 34*a*, links first electrical assembly 34*a* to a third electrical assembly 34*c* located in a third panel 20*c*. Electrically connecting the above described panels 20*a*–20*c* is possible because quad connector 62 allows two jumper cables 50*a* and 50*b* from two different panels 20*b* and 20*c* to be connected simultaneously. The distance between subsequent assemblies 34 is dependant upon the length of jumper cables 50 linking assemblies 34 as well as the size of panels 20. Assemblies 34 are spaced to provide an adequate number of receptacles 36 to the work space and may include from a single electrical assembly 34 or a plurality of assemblies 34 as is depicted in the present embodiment.

Figure 4:
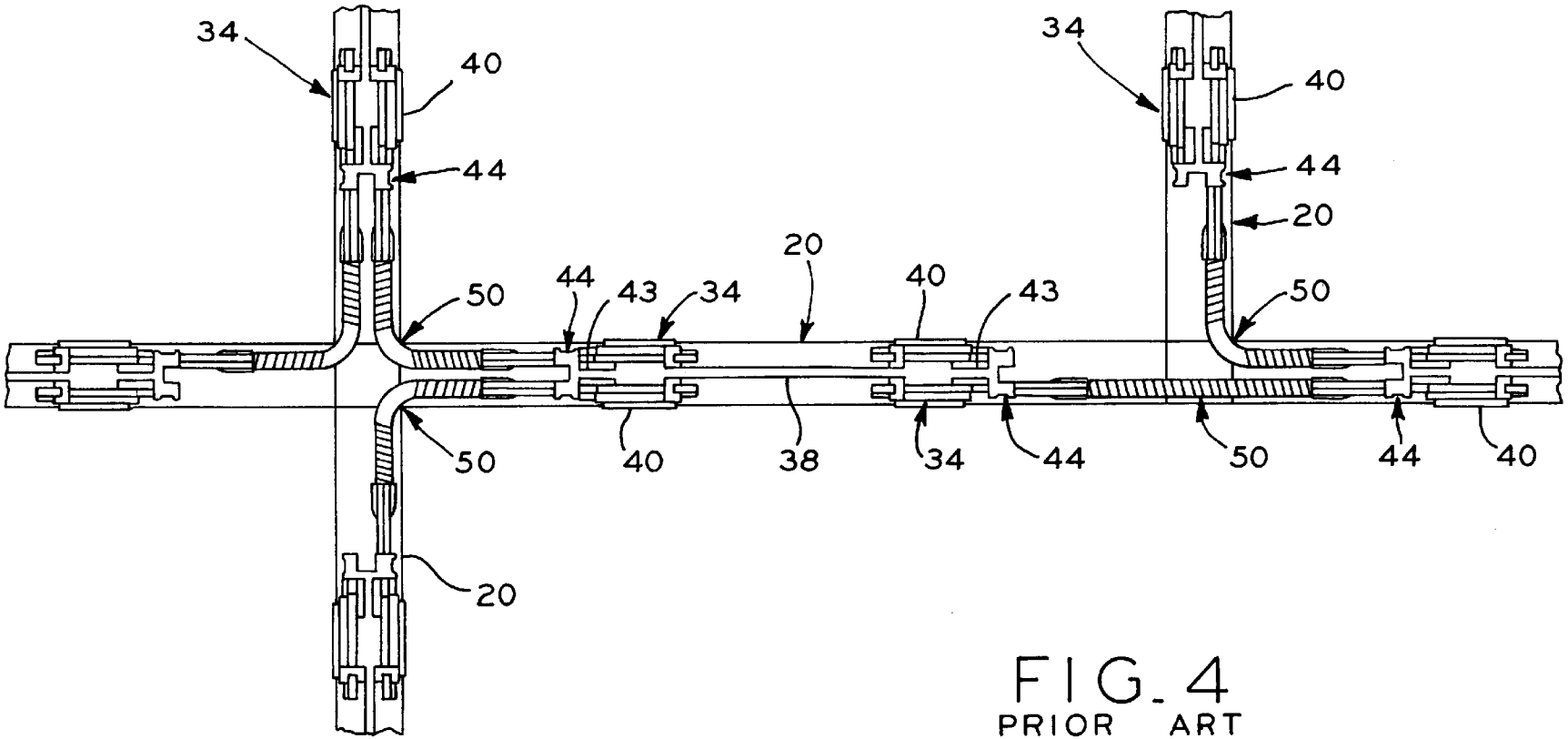
FIG. 4 PRIOR ART
FIG. 4 is a diagrammatic plan view of a prior art wiring assembly in an office panel assembly.
Figure 5:
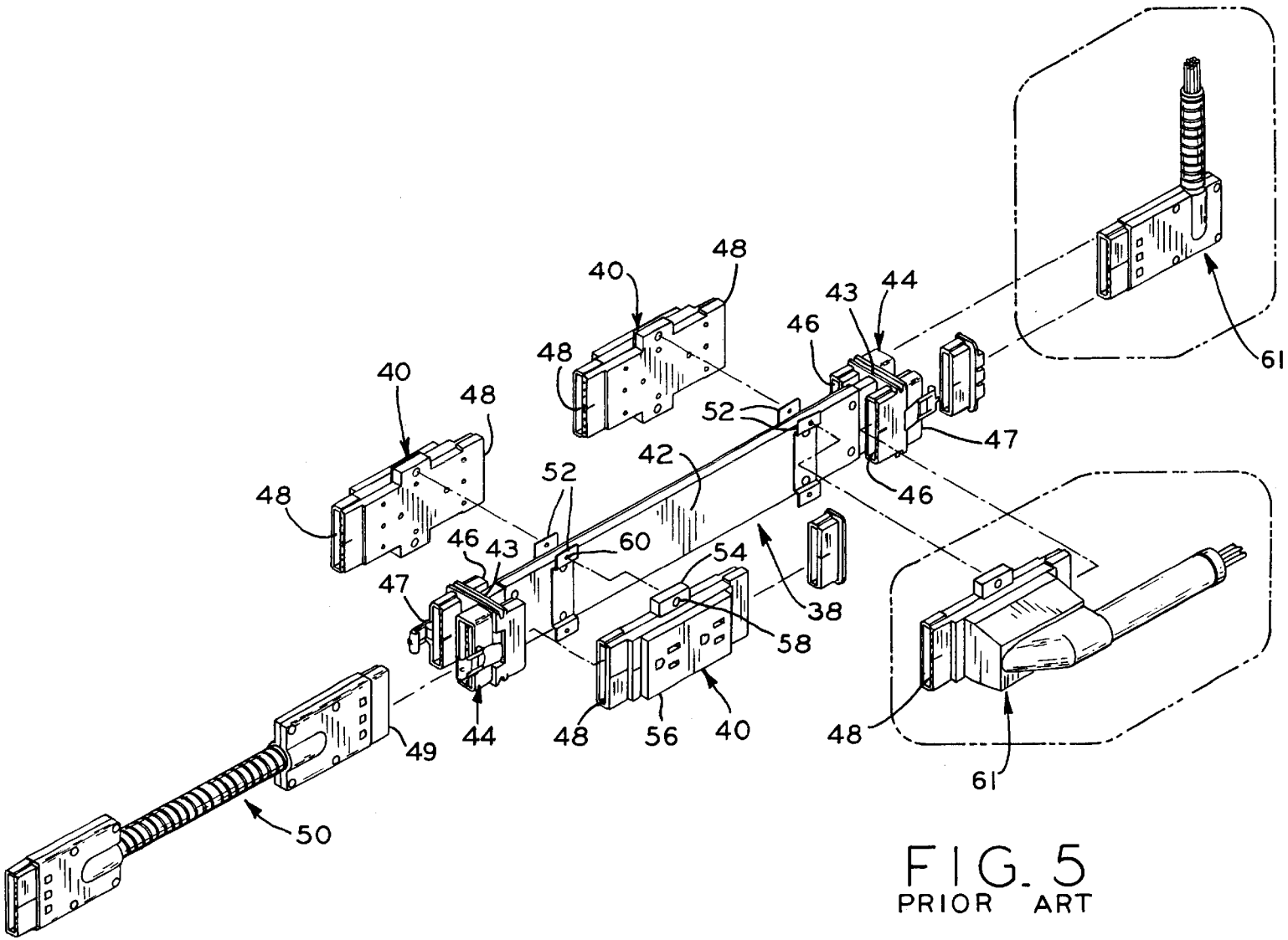
FIG. 5 PRIOR ART
FIG. 5 is an exploded perspective view of the prior art wiring assembly shown in FIG. 4.

Buss or distribution harness 38 of prior wiring systems disclosed in FIGS. 4 and 5 is an expensive component used in the construction of wiring assembly 30. The present invention eliminates distribution harness 38 by using receptacle 36 itself as the power distribution unit (FIG. 8) as will be described hereinbelow.

Figures 8, 9:
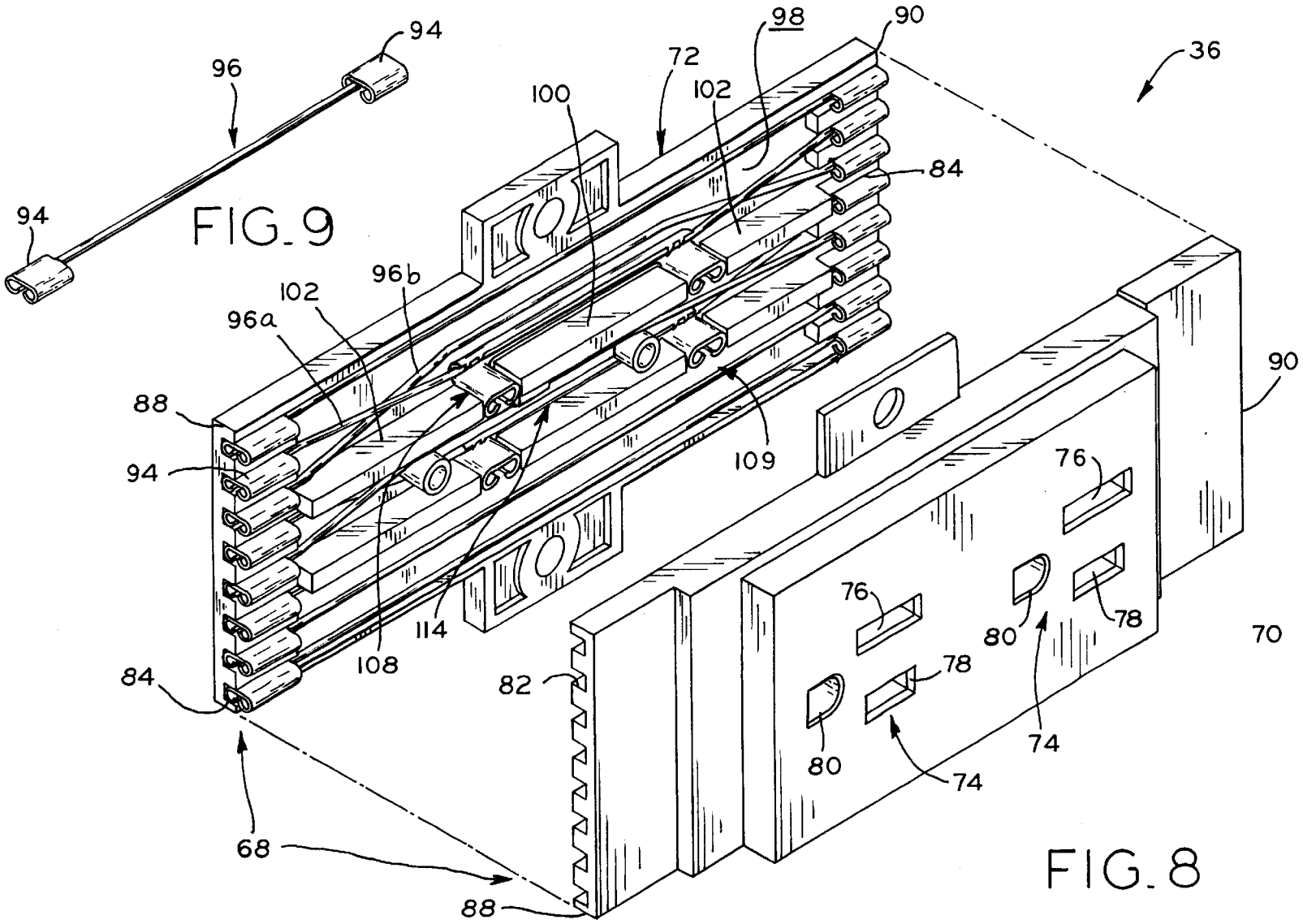
FIG. 8 is an enlarged, exploded perspective view of a receptacle of the office panel assembly shown in FIG. 1.
FIG. 9 is a perspective view of an internal electrical wire.
Figure 10:
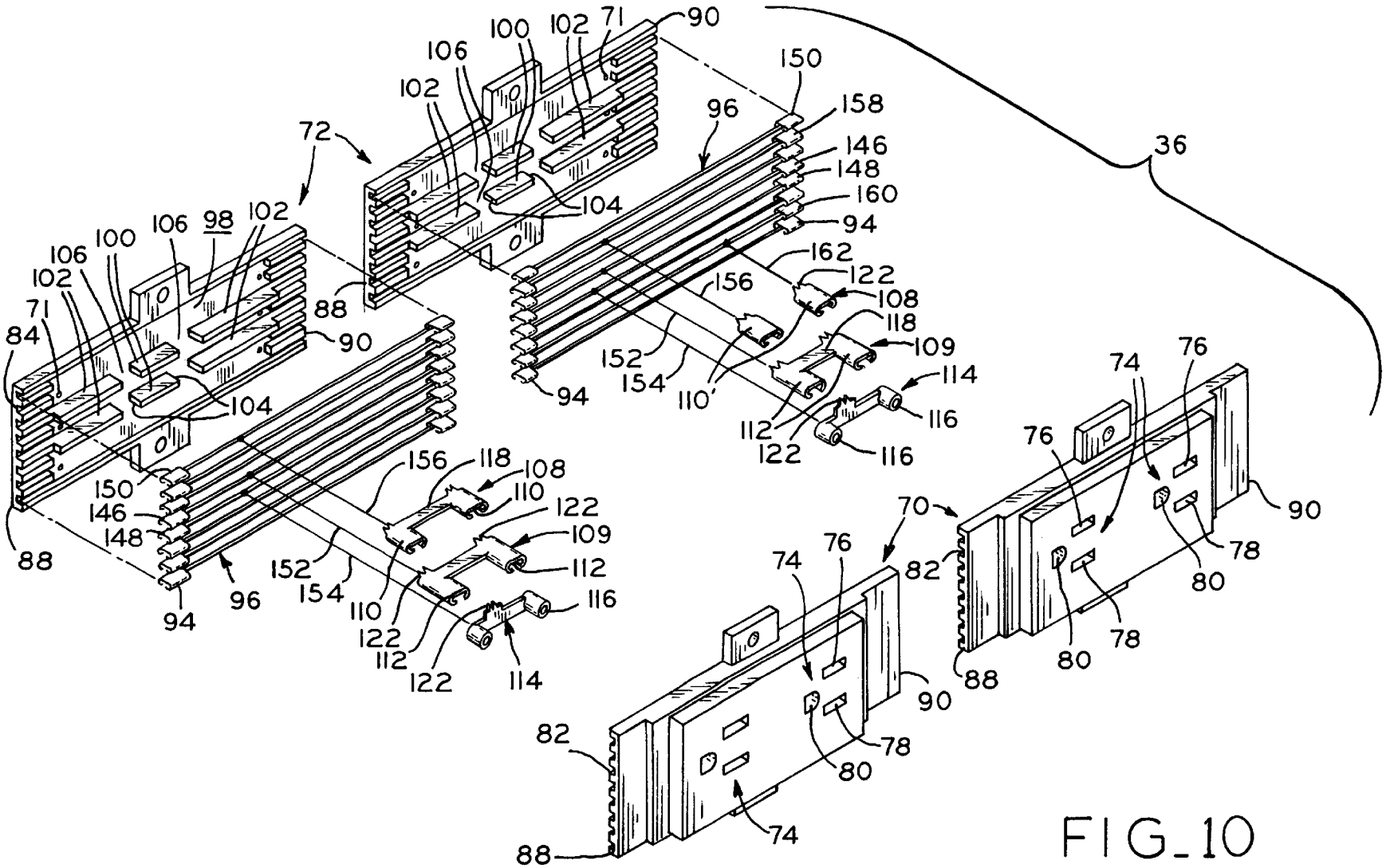
FIG. 10 is an exploded perspective view of a pair of duplex receptacles, one receptacle showing the electrical connections of a receptacle in the wiring system of the present invention and one receptacle showing and an alternative wiring scheme.

Referring more specifically to receptacle 36 shown in FIGS. 8 and 10, housing 68 includes a front plate 70 and rear plate 72 which are detachably joined by a plurality of integral pegs (not shown) and apertures 71 (FIG. 10). The pegs extend perpendicularly from the inner surface of front plate 70, aligning with and engaging and being welded or bonded to apertures 71 located in inner surface 98 of rear plate 72, thereby interlocking front plate 70 and rear plate 72. Housing 68 is constructed from a non-metallic material such as plastic including flame retardant polycarbonate, polystyrene, PVC, or ABS, by any suitable method including injection molding. Front plate 70 is provided with openings that define a pair of electrical sockets or outlets 74 in receptacle 36, making receptacle 36 a duplex receptacle. Each outlet 74 includes elongated apertures or slots 76 and 78 which allow prongs of a conventional electrical plug of any electrically operated device (not shown) to connect to a neutral wire and a hot wire carried within housing 68. Further provided to define grounded outlets 74 is a smaller, D-shaped aperture 80 disposed adjacent elongated slots 76 and 78 to enable an electrical connection between a ground prong of an electric plug and a ground wire in housing 68.

Each receptacle 36 carries a plurality of active conductors or wires 96 which extend the length of receptacle housing 68 as discussed above (FIG. 8). In a preferred embodiment, wires 96 have metal terminals 94 secured to both ends as shown in FIG. 9. Wires 96 are relatively loose to permit crossing over of wires 96. Wires 96 have an insulative jacket disposed thereon so as to protect against shorts in receptacle 36 when wires 96 are crossed as will be discussed below. Alternatively, conductors 96 may be stamped copper, cut to a specific length and shape necessary to create different circuits for receptacles 36 as will be described below. Crossing over of stamped copper conductors is not possible as they are not insulated from one another, thus contact between conductors 96 will create a short in receptacle 36. A third method of wiring receptacle 46 includes the use of a printed circuit board.

Front plate 70 and rear plate 72 have ends 88 and 90 with grooves 82 and 84 located in plates 70 and 72, respectively. When front plate 70 is assembled with rear plate 72, ends 88 and 90 of each plate align such that grooves 82 and 84 define openings 86 in each end 88 and 90 of housing 68 (FIGS. 6 and 7). Openings 86 are sized to received terminals 94 on wires 96 (FIGS. 8–10), holding wires 96 in position within housing 68. Once in place, terminals 94 are spaced from one another to define contacts in male sockets 66 at each end of receptacle 36.

Projecting substantially perpendicularly from inner surface 98 of rear plate 72 are partitions and 102 which are longitudinally spaced from one another. Partitions are shorter than partitions 102 and are centrally disposed between ends 88 and 90 of rear plate 72. A pair of partitions 102 are placed at each end 104 of partition , partitions and 102 being aligned along their longitudinal axes such that voids 106 exist between adjacent partitions and 102. Voids 106 are of sufficient size for receiving metal electrical connectors or spades 108 and 109 so that connectors 108 and 109 fit tightly within voids 106. Each electrical connector 108 and 109 includes a pair of female sockets 110 and 112, respectively, which align with slots 76 and 78 for receiving the male prongs of an electrical plug. Electrical connector 114 is disposed between the longitudinal sets of spacers and 102 such that female sockets 116 of connector 114 align with D-shaped apertures 80 for receiving the male ground prongs of an electrical plug. It is understood that any orientation of alternative partitions may be used to receive connectors 108, 109, 114 whereby the connectors are suitably supported.

Connectors 108, 109, and 114 are constructed from a conductive metal which, when connected with conductors such as wires 96 and being in contact with the prongs of the electrical plug, provide a pathway for electrical current traveling through wiring system 30 to the electrically operated device. Sockets 110, 112 and 116 are shaped such that the prongs of an electrical plug fit tightly in the sockets allowing for direct contact of the prongs and metal connectors 108, 109, and 114. Sockets 110 and 112 of electrical connectors 108 and 109, and sockets 116 of electrical connector 114 are integrally joined by bar 118. Along the lower edge of each socket 110, 112, and 116 is a pair of barbs 122. When electrical connectors 108, 109 and 114 are electrically joined to one wire 96, barbs 122 and bar 118 are folded around wire 96 (FIG. 8). In order for an electrical connection to be made, pressure is applied to barbs 122 causing barbs 122 to pierce the insulative covering about wires 96 to, contacting the bare copper wire, thereby providing a conductive pathway for electrical current.

When manufactured, each receptacle 36 may be wired to be on a specific circuit. Wires 96 are manufactured to include a small amount of slack between terminals 94 so that they may be crossed over one another, enabling connection of wires 96 positioned within housing 68 furthest from stationary connectors 108, 109 and 114 as illustrated in FIG. 8. For example, in the case of the circuit provided in receptacle 36 which is illustrated in FIG. 8, hot wire 96*a* is positioned a distance from electrical connectors 114. Therefore, in order for a connection to be made between conducting wire 96*a* and connector 114, wire 96*a* must be crossed over hot wire 96*b*. Housing 68 of each receptacle 36 is provided with a marking (not shown) such as a number or letter so that the circuitry located within the receptacle may be easily identified. By having receptacles 36 wired on specific circuits, panels 20 of a work space may be provided with any number of circuits to prevent overloading of a single circuit. Each work space may be provided with receptacles 36 all wired on the same circuit such that different work spaces have different circuits. A second option is to place a pair of receptacles 36 on the same circuit in one panel 20 and receptacles 36 of a second circuit in a second panel 20 of the work space, thereby supplying a work space with two circuits. Further, each receptacle 36 in one panel 20 could be on different circuits to provide each panel with two circuits. Another alternative may be to provide each individual outlet 74 with a separate circuit, providing panel 20 with four different circuits, two circuits in each receptacle 36.

Figure 11:
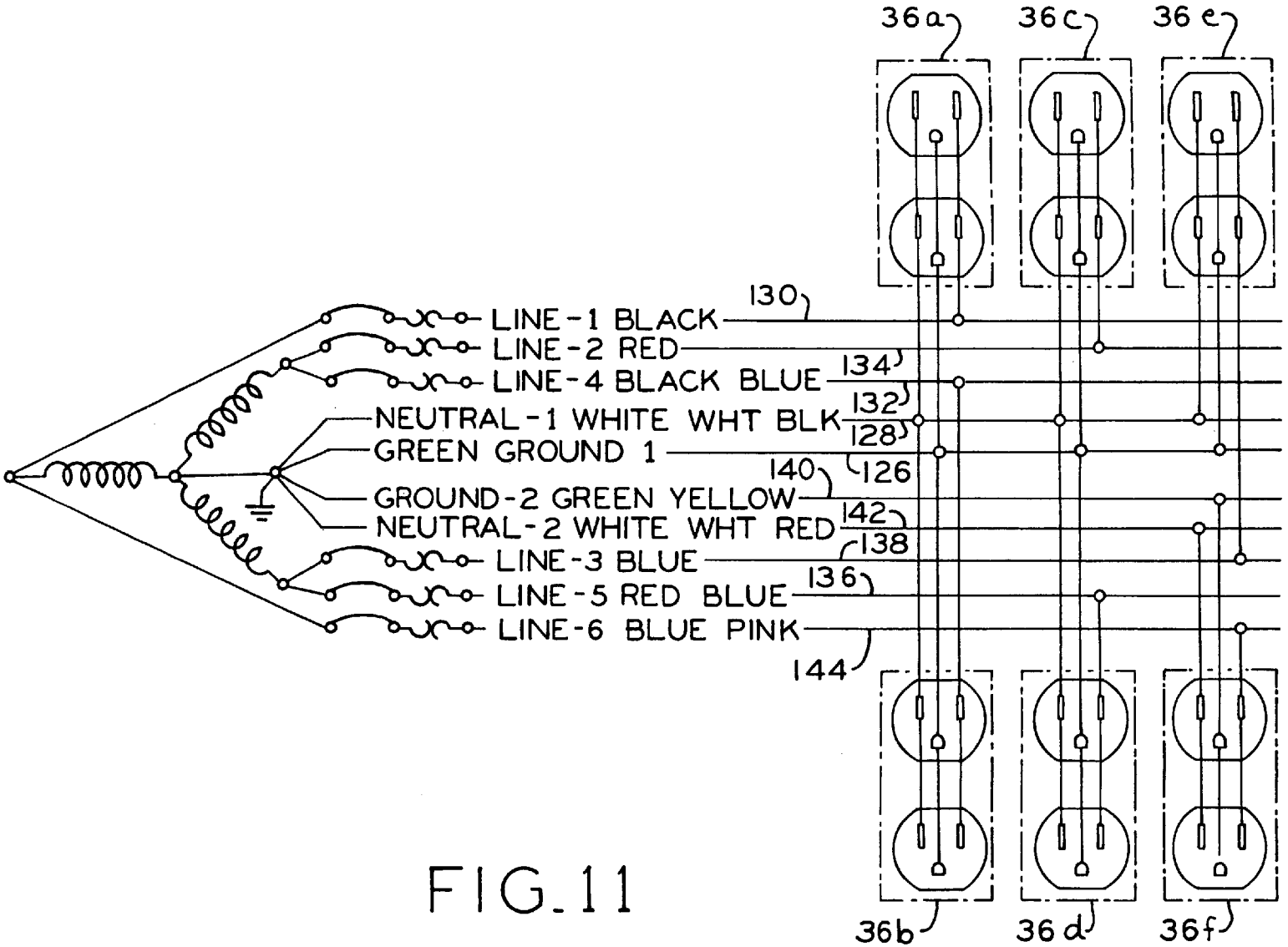
FIG. 11 is a schematic view of an exemplary wiring scheme for a plurality of duplex receptacles in accordance with the present invention.

In accordance with the present invention, receptacle 36 is wired to a specific circuit to allow for the different configurations of circuits in a work space as discussed above. Referring to FIG. 11, a schematic of one wiring scheme 30 is shown having ten wires electrically connected to six receptacles 36*a*–36*f*. It is understood that the illustrated wiring schematic may be the same for the prior art wiring system including the distribution harness as it is for the present invention. A wiring system 30 having eight wires is similar to the ten wire system shown in FIG. 11 having two fewer hot wires (FIG. 10) as will be discussed below. When wiring receptacles 36, all ten wires 96 are carried by the receptacles with three wires 96 being "picked off," or electrically connected to, by connectors 108, 109, and 114 to electrify outlets 74. The remaining wires 96 simply pass through receptacles 36 without being electrically connected to connectors 108, 109 and 114. Electrical current is supplied to all ten wires with only three being used to supply electricity to outlets 74. Sockets 49 of jumper cables 50 receive male socket 66 of receptacles 36 and carry current from one receptacle 36 to a second receptacle 36. With the receptacles 36 themselves carrying wires 96, distribution harness 38 used in previous systems is effectively eliminated.

Referring specifically to wiring system 30 of the schematic in FIG. 11, receptacle 36*a* is electrically connected to ground wire 126, neutral wire 128, and hot wire 130, such that outlets 74 of receptacle 36*a* are on one circuit. Duplex receptacle 36*b* is mounted directly behind receptacle 36*a* in the manner illustrated in FIG. 3, creating one electrical assembly 34 having a pair of duplex receptacles 36. Receptacle 36*b* is electrically connected to the same ground 126 and the same neutral wire 128. However, in order to place receptacle 36*b* on a second circuit, receptacle 36*b* must be electrically connected to a different, second hot wire 132. The next pair of receptacles 36*c* and 36*d* shown in FIG. 11 are on two additional circuits including ground and neutral wires 126 and 128, respectively. However, receptacle 36*c* is electrically connected to hot wire 134 and receptacle 36*d* is linked to hot wire 136. The third pair of receptacles 36*e* and 36*f*, furthest from receptacles 36*a* and 36*b*, are also on separate circuits. Receptacle 36*e* is electrically connected to ground 126, neutral wire 128 and hot wire 138, where ground 126 and neutral wire 128 are shared by receptacles 36*a*–36*d*. Receptacle 36*f* is wired to ground and neutral wires 140 and 142, respectively, and hot wire 144 wherein receptacle 36*f* has a pure, independent circuit in which the ground and neutral wires are not shared by adjacent receptacles. With each receptacle 36 being wired to have a separate, specific circuit, panels 20 may be easily provided with a plurality of circuits to prevent overloading of a single circuit.

With reference to FIG. 10, two receptacles 36 are shown with connectors 108, 109 and 114 schematically connected to ground, neutral, and hot wires 96 by lines 152, 154 and 156, respectively. These receptacles 36 are shown carrying eight wires 96. Although wires 96 are shown in FIG. 10 as being straight, it is understood that wires 96 may be crossed over adjacent wires in order to come in contact with connectors 108, 109 and 114. Receptacle 36 on the left side of FIG. 10 shows ground connector 114 electrically associated with ground wire 146 by line 152. Connector 109 is electrically connected with neutral wire 148 by line 154 and hot connector 108 is associated with hot wire 150 by line 156.

The second receptacle 36 shown on the right side of FIG. 10 shows an alternative method of wiring receptacle 36 in which each outlet 74 is wired to be supplied with electrical current by separate circuits. In order to accomplish this, sockets 110' of electrical connector 108 are separated by eliminating connecting bar 118. Each socket 110', 112 and 116 of a first outlet 74 are connected to three wires 96: one ground wire 146, one neutral wire 148 and one hot wire 158. Sockets 110', 112 and 116 of a second outlet 74 on the same receptacle 36 are electrically connected to the same ground wire 146 and neutral wire 148 as first outlet 74. Socket 110' of the second outlet 74 is connected to a second, different hot wire 160 by line 162, thereby placing the second outlet 74 on a separate circuit from the first outlet 74.

In assembling electrical assemblies 34 and thus wiring assembly 30, each receptacle 36 is first wired to be on a given circuit. To do this, sockets 110 of connector 108 are secured to a hot wire 96, sockets 112 of connector 109 are secured to a neutral wire 96, and sockets 116 of ground connector 114 are secured to a ground wire 96. Wires 96 need not be aligned parallel to one another, they may be crossed over one another to provide connection with connectors 108, 109 and 114 to produce the desired circuit (FIG. 8). Once receptacles 36 are produced, they are labeled with an identifying mark indicating the circuit for which the receptacle is wired. Receptacle 36 is electrically connected with jumper cable 50 (FIG. 6) and quad connector 62 (FIG. 7). Depending on the number of circuits being provided to a work space, receptacles 36 are electrically connected to one another to create electrical assemblies 34. Quad connector 62 is used if electrical assembly 34 is being provided with a pair of receptacles 36 mounted back-to-back or if panels 20 are oriented perpendicularly to one another. Male socket 66 of receptacle 36 is received by one female socket 64*a* and 64*b* of quad connector 62 to provide an electrical connection between quad connector 62 and receptacle 36, forming electrical assembly 34. A pair of adjacent electrical assemblies 34 are then joined by jumper cables 50 such that female socket 49 of cable 50 is received within one male socket 65*a* and 65*b* of connector 62. Once fully inserted into quad connector 62, locking tabs 63 lock onto jumper cable

50 to ensure full seating of male socket 65*a* and 65*b* of connector 62 into female socket 49 of cable 50. One electrical assembly 34 is then supplied with power from ceiling or floor entry supply 61 (FIGS. 6 and 7) which supplies electricity to receptacles 36 via jumper cable 50 and quad connector 62, thereby energizing electrical outlets 74 for use to supply electricity to any electrical equipment.

The sockets of jumper cables 50 and quad connectors 62 include individual connector terminals (not shown) that electrically contact terminals 94 to provide electrical continuity for each individual circuit.

While this invention has been described as having exemplary designs, the present invention may be further modified within the spirit and scope of this disclosure. Therefore, this application is intended to cover any variations, uses, or adaptations of the invention using its general principles. Further, this application is intended to cover such departures from the present disclosure as come within known or customary practice in the art to which this invention pertains.

What is claimed is:

1. An electrified partition system comprising:

a plurality of panels interconnected with each other to form a plurality of work spaces;

a plurality of receptacles mounted in raceways in said panels, each said receptacle comprising a housing and a plurality of conductors extending from one end of said housing to the other end of said housing and terminating in respective terminals, said conductors defining individual circuits;

at least one electrical plug socket in a face of each of said receptacle housings, each said plug socket comprising a plurality of connectors aligned with respective apertures in said housing face to thereby receive a standard multi-pronged electrical plug, said connectors connected to respective said conductors fewer in number than said plurality of conductors extending through said housing so that some of said conductors pass through said housing electrically isolated from said connectors;

multi-circuit cables removably electrically connected to said receptacles to form an electrical network; and a connector module having a first socket removably connected to one of said multi-circuit cables and a pair of second sockets removably and directly electrically connected to a pair of respective said receptacles with their respective plug sockets facing in opposite directions.

2. The partition system of claim 1 including ten said conductors extending through said housing.

3. The partition system of claim 1 including eight said conductors extending through said housing.

4. The partition system of claim 1, wherein at least one of said receptacles is a duplex receptacle having two of said sockets therein, wherein one of said sockets is connected to a conductor of one circuit and the other of said sockets is connected to a conductor of a different circuit.

5. The partition system of claim 4, wherein said second pair of sockets extend generally parallel to each other in a common direction, and said pair of receptacles are disposed in a back to back arrangement relative to each other.

6. The partition system of claim 1, wherein said second pair of sockets extend generally parallel to each other in a common direction, and said pair of receptacles are disposed in a back to back arrangement relative to each other.

7. The partition system of claim 6 wherein said connector module is generally H-shaped.

8. The partition system of claim 1 wherein:

two of said panels are connected perpendicularly to each other;

said pair of receptacles are mounted in one of said two panels; and said connector module includes a further socket removably connected to a said multi-circuit cable that extends into the other of said two perpendicularly connected panels.

9. The partition system of claim 8, wherein said second pair of sockets extend generally parallel to each other in a common direction, and said pair of receptacles are disposed in a back to back arrangement relative to each other.

10. The partition system of claim 8 wherein said further socket extends generally parallel to said first socket and faces in a common direction therewith.

11. An electrified partition system comprising:

a plurality of panels interconnected with each other to form a plurality of work spaces wherein two of said panels are connected perpendicularly to each other;

a plurality of receptacles mounted in raceways in said panels, each said receptacle comprising a housing and a plurality of conductors extending from one end of said housing to the other end of said housing and terminating in respective terminals, said conductors defining individual circuits;

at least one electrical plug socket in a face of each of said receptacle housings, each said plug socket comprising a plurality of connectors aligned with respective apertures in said housing face to thereby receive a standard multi-pronged electrical plug, said connectors connected to respective said conductors fewer in number than said plurality of conductors extending through said housing so that some of said conductors pass through said housing electrically isolated from said connectors;

multi-circuit cables electrically connected to said receptacles to form an electrical network; and a connector module having a first socket removably connected to one of said multi-circuit cables and a further socket removably connected to another said multi-circuit cable that extends into one of said two perpendicularly connected panels;

said connector module having a further socket removably connected to a said receptacle mounted in the other of said perpendicularly connected panels.

12. An electrified partition system comprising:

a plurality of panels interconnected with each other to form a plurality of work spaces;

a plurality of receptacles mounted in raceways in said panels, each said receptacle comprising a housing and a plurality of conductors extending from one end of said housing to the other end of said housing and terminating in respective terminals, said conductors defining individual circuits; and at least one electrical plug socket in a face of each of said receptacle housings, each said plug socket comprising a plurality of connectors aligned with respective apertures in said housing face to thereby receive a standard multi-pronged electrical plug, said connectors connected to respective said conductors fewer in number than said plurality of conductors extending through said housing so that some of said conductors pass through said housing electrically isolated from said connectors;

multi-circuit cables electrically connected to said receptacles to form an electrical network;

wherein at least one of said receptacles is a duplex receptacle having two said plug sockets therein, wherein one of said plug sockets is connected to a conductor of one circuit and the other of said plug sockets is connected to a conductor of a different circuit.

* * * * *